US005774772A

United States Patent [19]

Kai et al.

[11] Patent Number: 5,774,772

[45] Date of Patent: Jun. 30, 1998

[54] TONER CARTRIDGE HAVING A TONER STIRRING MEMBER

[75] Inventors: Tsukuru Kai, Fujisawa; Yoshiko Ishii, Tsukuba; Nobuto Yokokawa, Gotenba, all of Japan

[73] Assignee: Ricoh Company, Ltd., Tokyo, Japan

[21] Appl. No.: 663,667

[22] Filed: Jun. 14, 1996

[30] Foreign Application Priority Data

Jun. 14, 1995 [JP] Japan ..... 7-147623

[51] Int. Cl.[6] ..... G03G 15/08

[52] U.S. Cl. ..... 399/260; 399/263; 366/228; 366/342

[58] Field of Search ..... 399/254, 260, 399/262, 263; 366/227, 228, 229, 342, 343

[56] References Cited

U.S. PATENT DOCUMENTS

| | | | |
|---|---|---|---|
| 4,696,418 | 9/1987 | Kurotaka et al. | 222/167 |
| 5,296,900 | 3/1994 | Saijo et al. | 399/260 |
| 5,557,381 | 9/1996 | Sakamoto et al. | 399/111 |
| 5,598,254 | 1/1997 | Ikesue et al. | 399/262 |

*Primary Examiner*—Joan Pendegrass
*Attorney, Agent, or Firm*—Oblon, Spivak, McClelland, Maier & Neustadt, P.C.

[57] ABSTRACT

A toner cartridge for an image forming apparatus is provided with a toner stirring member, which is mixed in with the toner in the toner cartridge. Blocking of the toner is prevented and fluidity of the toner is improved by the movement of the toner stirring member in the toner cartridge, and stable toner flow to a developing device of is accomplished. The toner stirring member is provided with toner scratching portions for scratching off the toner from the internal surface of the cartridge, and thereby a quantity of toner remaining in the toner cartridge is reduced.

65 Claims, 13 Drawing Sheets

TONER CARTRIDGE HAVING A TONER STIRRING MEMBER

BACKGROUND OF THE INVENTION

1. Field of the Invention

The present invention generally relates to a toner cartridge which is detachably mounted onto a toner supply unit of an electrophotographic image forming apparatus, such as a reproduction machine or the like.

2. Discussion of the Background

Generally, a toner cartridge for replenishing toner to an electrophotographic image forming apparatus utilizing dry powder type toner for development is detachably mounted onto a toner supply unit from which toner is supplied to a developing device of the image forming apparatus. A first type of such a toner cartridge has an opening on a top end and is then turned upside down when mounted to the toner supply unit, and toner contained in the toner cartridge drops into the toner supply unit by gravity. A second type of such a toner cartridge has a cylindrical shape, and has a slit-like opening through a cylindrical wall and is mounted horizontally on the toner supply unit. Once mounted on the toner supply unit, the toner cartridge is rotated so that the toner moves through the slit-like opening to the toner supply unit. A third type of such a toner cartridge includes a L-shaped pipe for guiding the toner out from the toner cartridge. This toner cartridge is mounted on a toner supply unit and the toner is guided out of the toner cartridge through the L-shaped pipe with the rotation of the toner cartridge.

Each of these toner cartridges suffers from significant drawbacks.

With the first type of toner cartridge, a relatively large space is required above a developing device for mounting the toner cartridge on the top of the developing device. Therefore, such a toner cartridge is not suitable for use in a small image forming apparatus, especially in a case that a developing device is located in a relatively upper part of the image forming apparatus.

With the second type of toner cartridge having the slit opening, toner tends to coagulate and be blocked around the slit opening, since the slit opening is generally made relatively narrow so as to be sealed properly. To avoid such a toner blocking, an operator is urged to shake the toner cartridge before mounting the toner cartridge on a toner supply unit, to improve fluidity of the toner and to prevent maldistribution of the toner in the toner cartridge. However, it is troublesome to shake the toner cartridge before mounting to an apparatus, and further, there is a problem that no vibration is added to the toner cartridge once the toner cartridge is mounted to the apparatus. As a result, the toner tends to coagulate gradually by its own weight.

The third type of toner cartridge with the L-shaped pipe needs to be mounted to a toner supply unit with its bottom up, and therefore, this type of toner cartridge also needs a certain space above the toner supply unit. Further, there is a drawback in that all of the toner can not be fed out from the toner cartridge because of the L-shaped pipe, and as a result, the operator tends to soil his or her hands when replacing the toner cartridge due to this remaining toner.

The present applicant previously proposed a toner cartridge which is mounted horizontally to a side part of a toner supply unit and which has a spiral rib on an internal surface of the toner cartridge for guiding toner in the direction of an opening with the rotation of the toner cartridge (Japanese Patent Publication Tokukouhei 5-6194). Such a toner cartridge is suitable for use in an image forming apparatus having a developing device at the upper part of the apparatus, and further, has such an advantage to reduce the quantity of the toner which remains in the toner cartridge.

However, there is still a problem in such a toner cartridge that the toner sticks electrostatically on the internal surface of the toner cartridge. As a result, the whole amount of the toner in the toner cartridge is not fed out from the toner cartridge to the toner supply unit.

SUMMARY OF THE INVENTION

Accordingly, and in view of such problems encountered in the presently available toner cartridges, one object of the present invention is to provide a novel toner cartridge which prevents coagulation of the toner and increases fluidity of the toner even after the toner cartridge is mounted to an image forming apparatus, and which further allows toner which is stuck on an internal surface of the toner cartridge to be effectively removed.

In accordance with the objects of the present invention, the novel toner cartridge of the present invention is provided with a toner stirring member, which is mixed with the toner in the toner cartridge to prevent toner blocking and coagulation and to improve fluidity of the toner.

In accordance with another aspect of the present invention, the toner stirring member is provided with a scratching portion for scratching toner away from the internal surface of the toner cartridge.

In accordance with another aspect of the present invention, a projection for lifting the toner stirring member upwards during rotation of the toner cartridge is formed on the internal surface of the toner cartridge.

In accordance with another aspect of the present invention, the toner cartridge is provided with a partition member through which the toner passes but which prevents the toner stirring member from moving out of the toner cartridge.

In accordance with another aspect of the present invention, the toner cartridge includes partition members which divide the internal space of the toner cartridge into a plurality of spaces. A toner stirring member may be included in each of the spaces, and the partition members prevent the toner stirring member from moving out of each respective space while allowing the toner to pass therethrough.

In accordance with another aspect of the present invention, the toner cartridge is constructed from a plurality of cylindrical containers which each include respectively a thin sheet-shaped toner stirring member attached on one end surface. An opening of one end of the toner cartridge which is thus constructed by connecting a plurality of cylindrical containers is closed by a covering member.

In accordance with another aspect of the present invention, the toner cartridge is provided with a spiral projection on the internal surface of the toner cartridge for guiding toner towards an opening of the toner cartridge, and the spiral projection has at least one discontinuity through which the toner stirring member passes, thereby preventing movement of the toner stirring member past the discontinuity, and thereby preventing the toner stirring member from moving out of the toner cartridge.

In accordance with another aspect of the present invention, the toner stirring member is made of a magnetic material, and such a toner stirring member is prevented from moving out of the toner cartridge by providing another magnetic member outside and around the toner cartridge, and magnetizing one of the members.

By forming a toner cartridge with such a construction of the present invention and including the toner stirring member in the toner cartridge, a more stable toner supply can be supplied from the toner cartridge. This results in the present invention because of the use of the stirring member moving through the toner, which increases a fluidity of the toner and prevents toner coagulation. Further, the use of such a toner stirring member decreases the amount of toner which is not fed out and would remain in the toner cartridge.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein:

FIG. 16(*b*) is an illustration showing an example of a groove which is provided along a longitudinal direction of the toner cartridge in each space formed by a spiral projection;

FIG. 20(*b*) is an illustration showing a transverse cross section of the partition member;

FIG. 20(*c*) is an illustration of a toner cartridge segment of FIG. 20(*a*);

DESCRIPTION OF THE PREFERRED EMBODIMENTS

Figure 1:
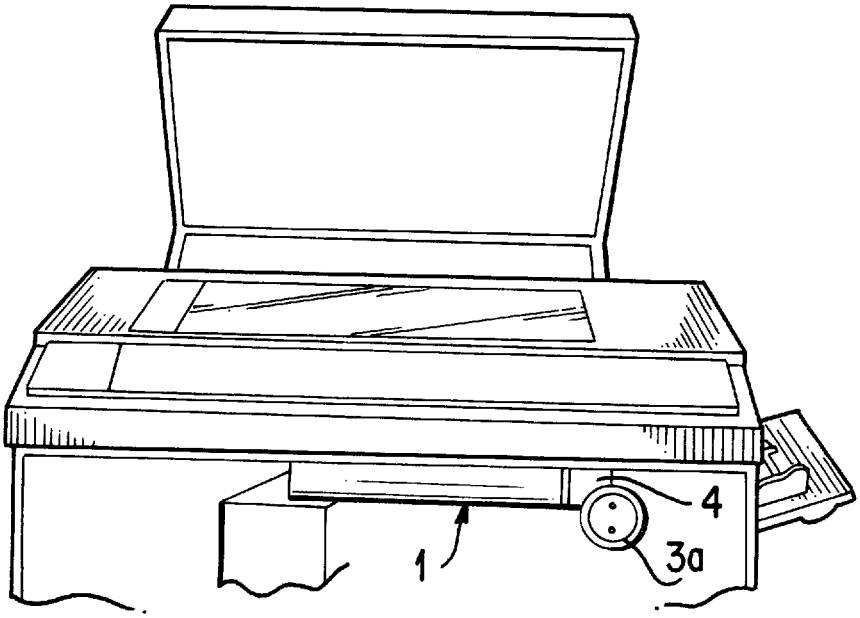
FIG. 1 is a partial schematic illustration of a reproduction machine in which a toner cartridge according to the present invention is mounted.

The present invention will now be described in detail with respect to the accompanying drawings in which like reference numerals designate identical or corresponding parts throughout the several views.

Figure 2:
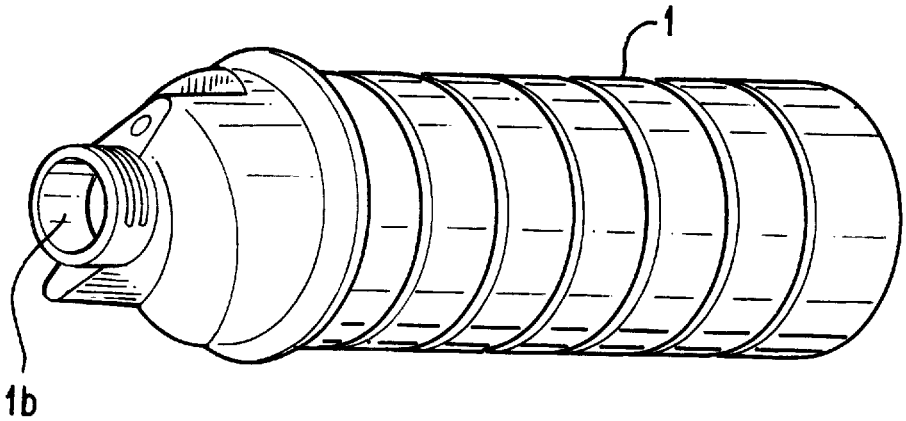
FIG. 2 is a perspective view illustrating an example of a toner cartridge.

FIG. 1 illustrates a reproduction machine which is provided with a toner cartridge 1 related to the present invention. A cylindrically shaped toner cartridge 1, which is shown in FIG. 2 and is referred to as a toner cartridge or a toner bottle, is connected to a projecting cylinder part 3*a* of a toner supply unit 3 through a joint 4, as shown in greater detail in FIG. 3. The toner cartridge 1 is held horizontally in a toner cartridge holder 2 which projects from the toner supply unit 3 over a developing device (not shown) of the reproduction machine. The holder 2 is held to pivot downwards and upwards relative to the projecting cylinder part 3*a*, and is pivoted downwards when mounting the toner cartridge 1 thereon. After mounting the toner cartridge on the holder 2, the holder 2 is pivoted upwards and is connected to the upper frame of the main body of the reproduction machine by a magnet 2*a* to be held horizontally. When the toner cartridge holder 2 is in such a horizontal position, the toner cartridge 1 is connected to the toner supply unit 3 which is provided on a part of the main body of the reproduction machine.

Figure 3:
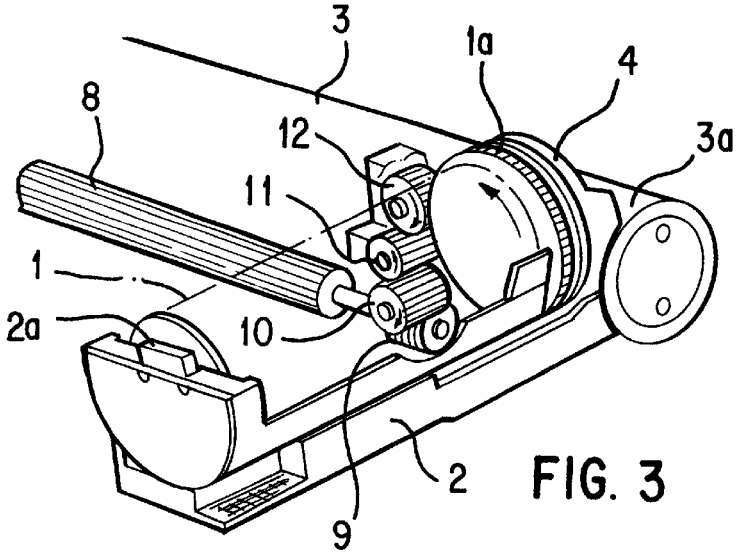
FIG. 3 is a schematic perspective illustration showing a state where the toner cartridge is mounted to the reproduction machine shown in FIG. 1.
Figure 4:
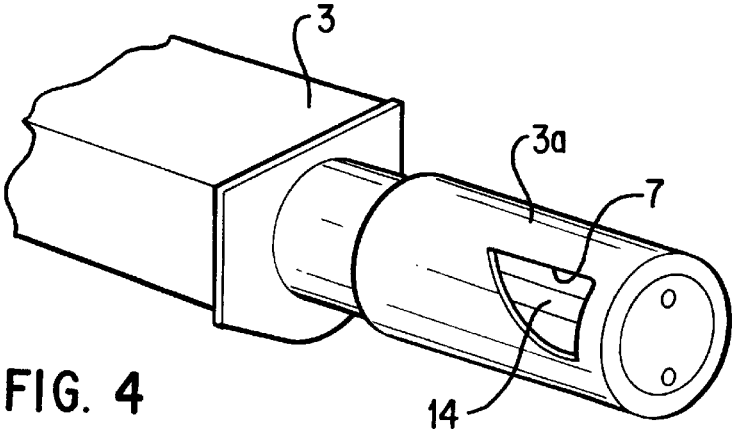
FIG. 4 is a schematic illustration showing a toner inlet area of a toner supply unit.

A gear portion la formed on one end of the toner cartridge 1 is engaged with an intermediate gear 12, and the toner cartridge 1 is rotated by a roller 8 of a toner supply unit 3 through a worm 9, a worm wheel 10, an idle gear 11, and an intermediate gear 12, in the direction indicated by the arrow in FIG. 3, as an example. When the toner cartridge 1 rotates, the toner is carried and forwarded by a spiral projecting portion which is formed on the internal surface of the toner cartridge 1 to the direction of an opening 1*b* of the toner cartridge 1. The toner is then fed to the toner supply unit 3 through joint 4 and the projecting cylinder portion 3*a*. As shown in FIG. 4, toner is transferred into the projecting cylinder portion 3*a* through a toner receiving opening 7 which is formed on the projecting cylinder portion 3*a*, and is further moved towards the toner supply unit 3 by an agitator (not shown in the drawings) which is mounted on a built-in shaft 14.

In a background toner cartridge, when the toner cartridge does not rotate for a period of time, the toner may coagulate and thereby lose certain fluidity. Further, in a background toner cartridge, toner will remain on the inner surface walls thereof, which thereby reduces the amount of toner fed out from each toner cartridge and which may also make replacement of the toner cartridge more difficult.

Figure 5A:
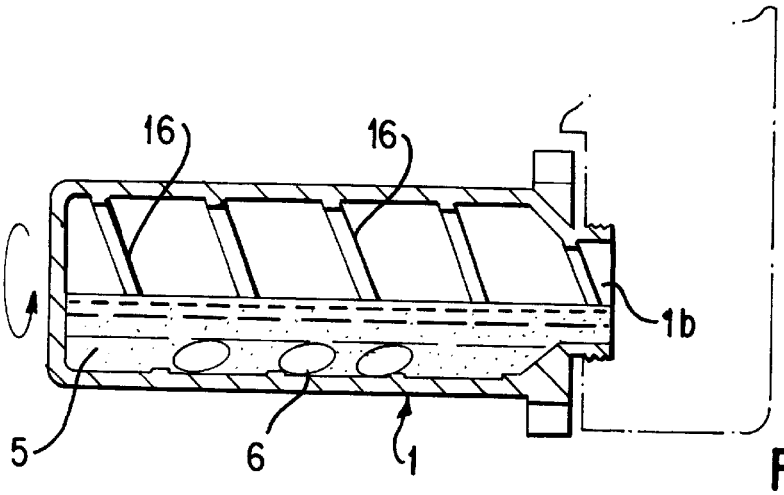
FIG. 5(*a*) and FIG. 5(*b*) are sectional illustrations of toner cartridges according to the present invention.
Figure 5B:
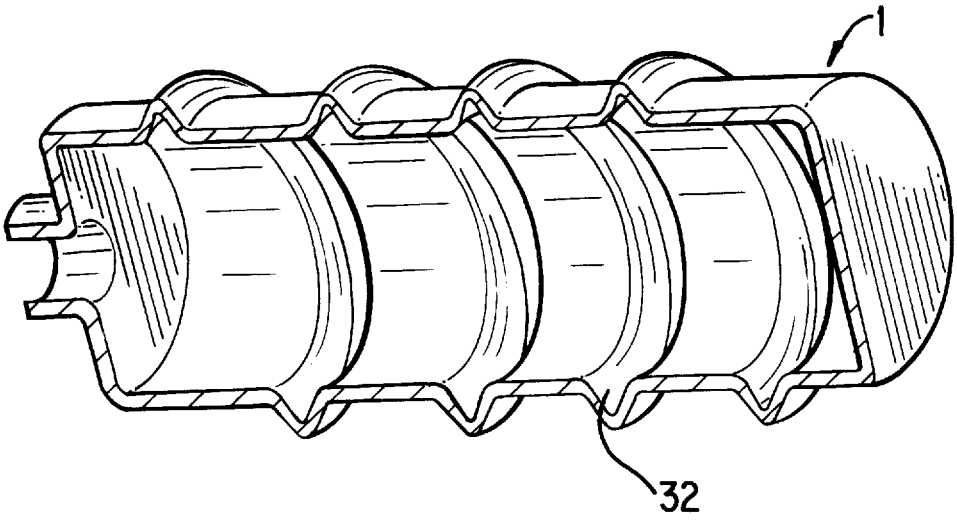

The present invention overcomes such drawbacks in such background toner cartridges. More particularly, in the present invention, and as is shown in FIG. 5(*a*) of the present specification as an example, toner stirring members 6 are mixed in with the toner 5. These toner stirring members 6 move when toner cartridge 1 is rotated. The movement of these toner stirring members 6 prevents toner 5 within the toner cartridge 1 from coagulating and increase the fluidity of the toner 5. Further, the toner stirring member 6 are provided with surfaces which scrape the toner 5 off of the inner surfaces of toner cartridge 1, so that all of the toner 5 inside the toner cartridge 1 is utilized.

It is preferable to provide a spiral projecting portion 16 on the internal surface of the toner cartridge 1 as shown in FIG. 5(*a*) for applying a forwarding force to the toner 5 to forward the toner 5 towards the opening 1*b* of the toner cartridge 1 when the toner cartridge 1 is rotated. As a further alternative embodiment, and as is shown in FIG. 5(*b*), the spiral projection 16 can be replaced by a spiral groove 32, and such a spiral groove 32 is also utilized for applying a forwarding force to toner placed inside the toner cartridge 1.

Figure 6:
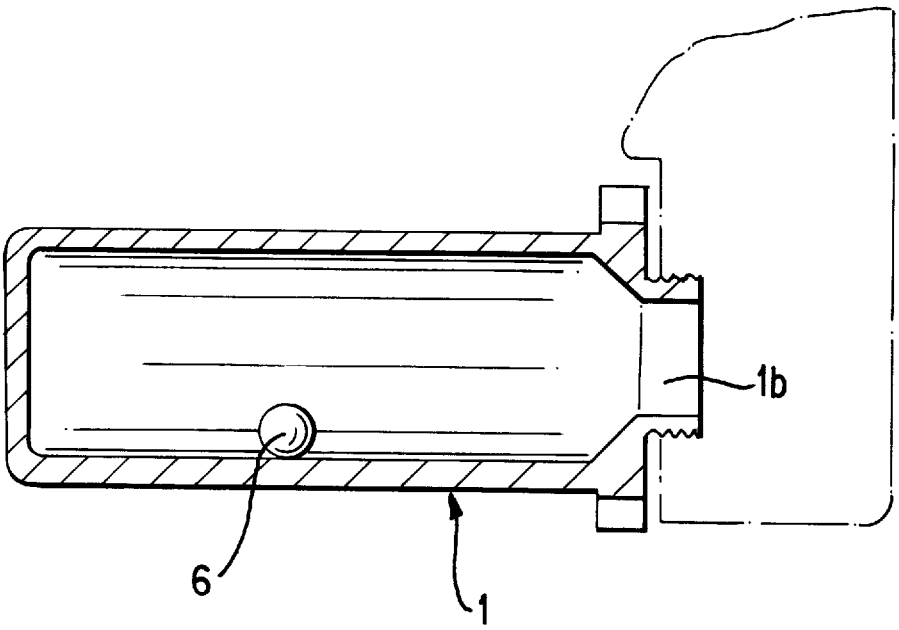
FIG. 6 is a schematic sectional illustration showing a further toner cartridge according to the present invention.

However, even if the toner cartridge 1 does not include such a spiral projecting portion 16 or groove 32 on the internal surface of the toner cartridge 1, i.e., if the internal surface of the toner cartridge 1 is smooth as shown in FIG. 6, an increase in fluidity of the toner contained in the toner cartridge 1 is accomplished by the movement of the aforementioned toner stirring member 6, and the toner is fed towards the opening 1*b* of the toner cartridge 1 with the rotation of the toner cartridge 1.

In this way, the use of toner stirring member 6 mixed with the toner in the toner cartridge 1 prevents coagulation of the toner, increases fluidity of the toner, and provides that the toner on the inner surface of the toner cartridge 1 is removed therefrom and utilized.

The toner stirring member 6 may be shaped, as an example, as a small thin plate-shaped element in which a plane part pushes apart the toner when the toner stirring member 6 moves with the rotation of the toner cartridge 1. It is preferable to mix a plurality of the toner stirring members 6 in with the toner. The greater the number of the stirring members 6 which are included in the toner cartridge 1, the greater the increase in the fluidity of the toner. Further, an edge part of the toner stirring member 6 scratches the toner which is stuck on the internal surface of the toner cartridge 1 away from the internal surface of the toner cartridge 1, thus decreasing the amount of the toner which is not fed out and which remains in the toner cartridge 1.

The material of the toner stirring member 6 is preferably selected from such materials having a specific gravity equal to or greater than that of the toner, for example, aluminum, iron, resin, or the like. The greater the specific gravity of the toner stirring member 6, the faster the velocity of the toner stirring member 6 to sink into the toner, when mixed and stirred with the toner, and thereby the better the toner stirring member 6 stirs the toner, while sinking down, with an action of pushing apart the toner. As a result, the fluidity of the toner is increased when thus stirred by the toner stirring member 6, and consequently, the toner moves more easily towards the opening 1*b* of the toner cartridge 1.

Figure 7A:
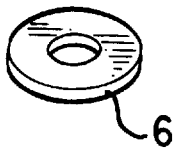
FIG. 7(*a*)–FIG. 7(*c*) are illustrations showing examples of a composition of a toner stirring member.
Figure 7B:
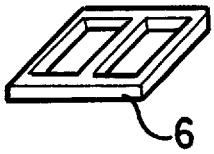
Figure 7C:
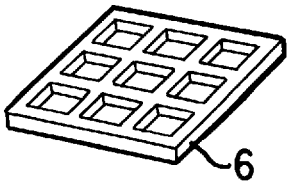

Various examples of the toner stirring member 6 are shown in FIGS. 7(*a*) through 11(*c*). A toner stirring member 6 which may be provided with at least one hole or opening is shown in FIGS. 7(*a*)–7(*c*). A larger effect of stirring and resulting improvement of the fluidity of the toner is obtained by such a hole since the toner passes through the hole or opening when the toner stirring member 6 moves around.

Figure 8:
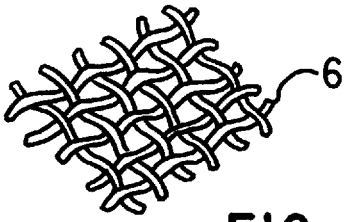
FIG. 8 is an illustration showing an example of a net shaped toner stirring member.

Further,the toner stirring member 6 may be composed of a net-like shape as shown in FIG. 8. The effect of the hole as mentioned above is further increased by making the toner stirring member 6 into a net-like shape. Further, the toner which is stuck on the internal surface of the toner cartridge 1 is scratched off to fine pieces by edge portions of the net-like shaped member 6 when the net-liked shaped member 6 moves around in the toner cartridge 1.

Figure 9A:
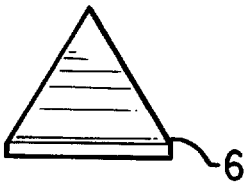
FIG. 9(*a*)–FIG. 9(*c*) are illustrations showing examples of other compositions of a toner stirring member.
Figure 9B:
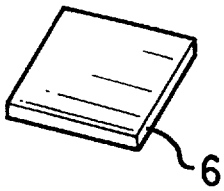
Figure 9C:
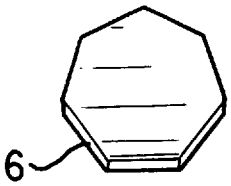

When the toner stirring member 6 is formed into a simple plane shape as shown in FIGS. 9(*a*)–9(*c*), the toner stirring member 6 is preferably shaped as a polygon having a suitable number of angles of more than 3. The toner on the internal surface of the toner cartridge 1 is exfoliated when the angles of the polygon-shaped toner stirring member 6 collide with the internal surface of the toner cartridge 1.

The suitable number of angles here means a number of angles with which the polygon can be so shaped to have such a degree of an angle with which scratching off of the toner from the internal surface of the toner cartridge 1 is expected. Namely, if a toner stirring member 6 in a shape of a simple plane sheet is shaped as a polygon having a large number of angles, each angle of such a polygon-shaped sheet becomes obtuse, and as a result the effect of the angle on scratching off the toner from the internal surface of the toner cartridge 1 is decreased.

Figure 10A:
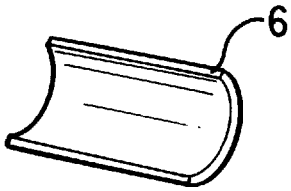
FIG. 10(*a*) and FIG. 10(*b*) are illustrations showing examples of still other compositions of a toner stirring member.
Figure 10B:
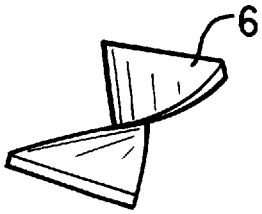

Further,it is preferable to compose the toner stirring member 6 as a twisted small chip sheet as shown in FIGS. 10(*a*) and 10(*b*). The toner stirring member 6 then moves irregularly due to the twisted form, and such an irregular movement of the twisted sheet creates a space among the toner with a pushing apart action. The velocity of the toner to flow into such a space changes at random, and therefore, the toner is stirred more effectively.

Figure 11A:
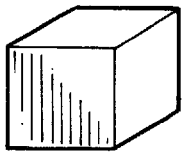
FIG. 11(*a*)–FIG. 11(*c*) are illustrations showing examples of still other compositions of a toner stirring member.
Figure 11B:
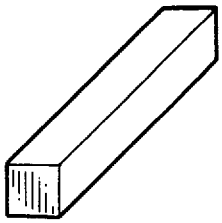
Figure 11C:
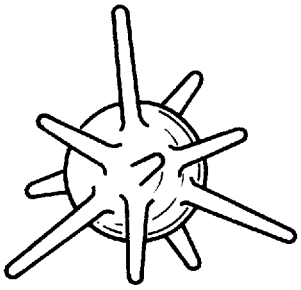

Further, the toner stirring member 6 may be shaped into a ball, a cube, a polyhedron or a stick as shown in FIGS. 11(*a*)–11(*c*). The toner stirring member 6 may be formed into an eccentric ring or may be composed of a plurality of eccentric rings which are made of a different material respectively, so that the toner stirring member 6 moves irregularly, thereby increasing the effect of stirring the toner. Further, a toner stirring member 6 shaped in a ball shape may be provided with a plurality of projections on its surface as shown in FIG. 11(*c*). Such projections scratch off the toner from the internal surface of the toner cartridge 1. Further, the toner stirring member 6 which is made in such a form as shown in FIG. 11(*c*) moves freely in the toner cartridge 1 by making the height of such projections higher than that of the spiral projection 16 formed on the internal surface of the toner cartridge 1.

Figure 12:
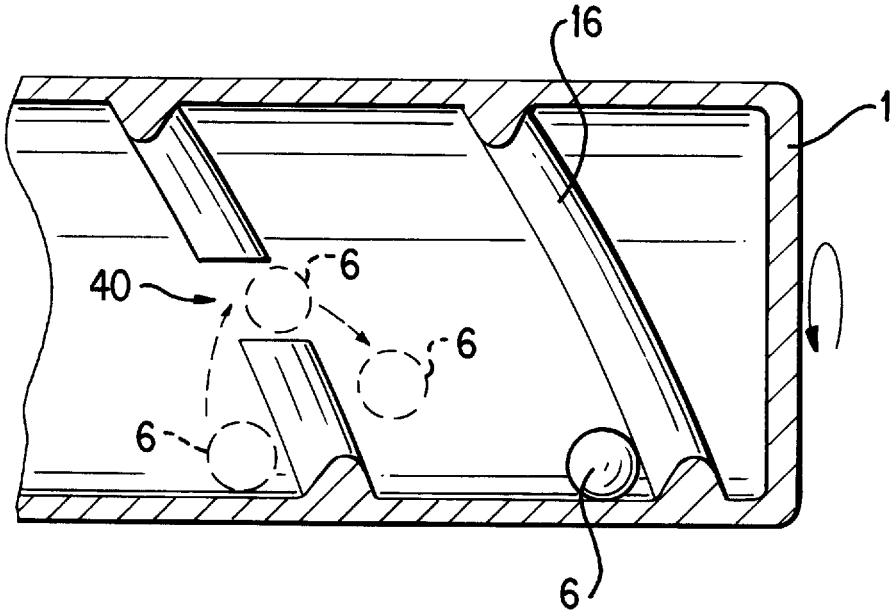
FIG. 12 is an illustration showing an example of a spiral projection having a discontinuity.

Further,as shown in FIG. 12, the spiral projection 16 formed on the internal surface of the cartridge 1 may be provided with at least one discontinuity 40. The toner stirring member 6 which is forwarded toward the opening of the toner cartridge 1 along the spiral projection 16 with the rotation of the toner cartridge 1 will pass through such a discontinuity 40, as shown by the dotted lines in FIG. 12, thus preventing the toner stirring member 6 from being discharged out of the toner cartridge 1. That is, since the toner stirring member 6 continuously passes through the discontinuity 40, the toner stirring member 6 is not transported past the discontinuity 40, and thus does not approach the opening 1*b* of the toner cartridge 1. A width size of such a discontinuity 40 is made larger than the toner stirring member 6 so that the toner stirring member 6 passes through the discontinuity 40, and thus is not advanced to the front of the toner cartridge 1.

Figure 13:
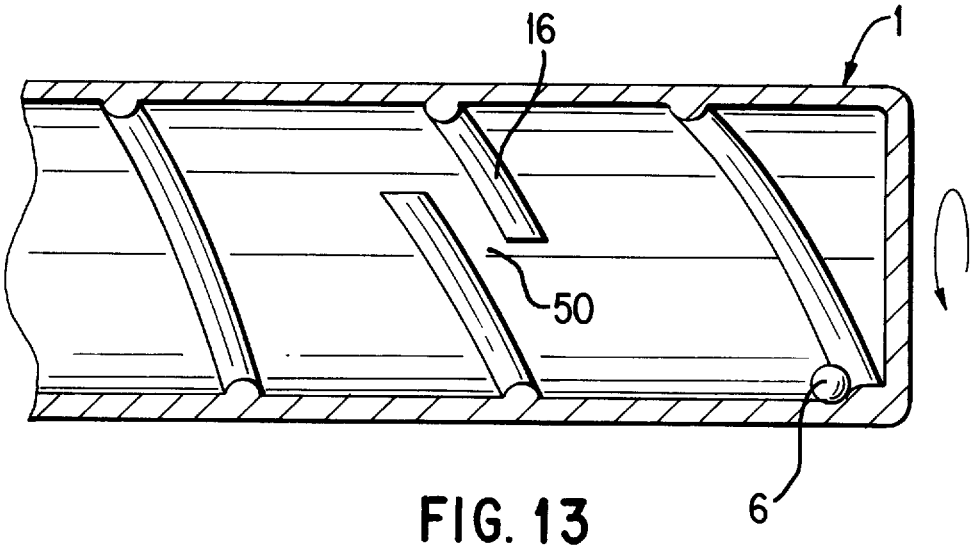
FIG. 13 is an illustration showing another example of a spiral projection having a discontinuity.

Further, and as shown in FIG. 13, for preventing the toner stirring member 6 from moving out of the toner cartridge 1 while maintaining the forwarding force of the spiral projection 16, similarly as shown in FIG. 12, a plurality of spiral projections 16, which are separated from each other by a discontinuity 50 may be provided. That is, in this further structure of the present invention, a plurality of spiral projections 16 may be formed, and these spiral projections 16 have an overlap, but are separated from each other to form a discontinuity 50. This discontinuity 50 is made larger than the toner stirring member 6 so that the toner stirring member 6 passes through the discontinuity 50, and thus is not propelled forward toward the opening 1*b* of the toner cartridge 1. In this way, the toner stirring member 6 which is included in a space formed by two spiral projections 16 is prevented from moving out of the space if the discontinuity 50 between such two spiral projections 16 is made larger than the toner stirring member 6, so that the toner stirring member passes through the discontinuity 50, and thus is not advanced.

Figure 14:
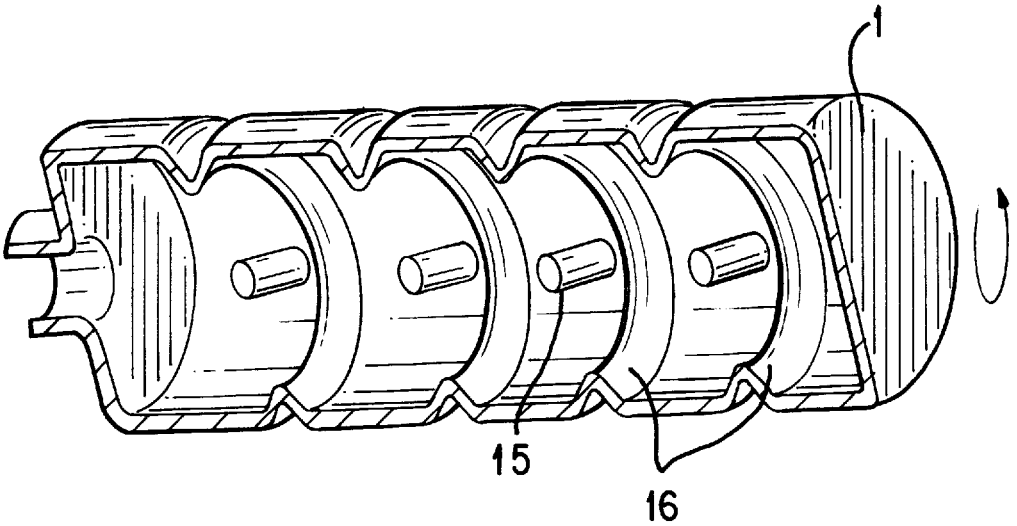
FIG. 14 is an illustration showing an example of a toner cartridge provided with a projection inside of the toner cartridge.

As a further feature of the present invention as shown in FIG. 14, at least one rod-shaped projecting portion 15 may be provided on the internal surface of the toner cartridge 1. The toner stirring member 6 which is mixed into the toner may then catch onto the projecting portion 15 and be lifted up with the rotation of the toner cartridge 1. Each time when the lifted toner stirring member 6 falls down, the toner is stirred. This lifting action thus increases the force of the toner stirring member falling down, and thus increases the stirring effect. If a distance between two adjacent projecting portions 15 is made smaller than a dimension of a side of the toner stirring member 6, the toner stirring member 6 may be more securely caught between two adjacent projecting portions 15, and thus is more securely lifted up, and the aforementioned effect on stirring the toner is thereby increased.

Figure 15:
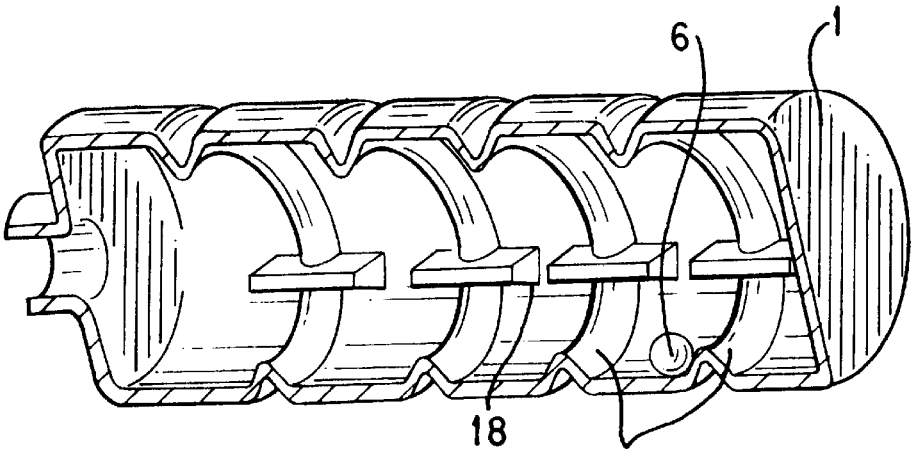
FIG. 15 is an illustration showing an example of a toner cartridge which is provided with a further projection inside of the toner cartridge.

Further, and as shown in FIG. 15, a projection 17 provided on the internal surface of the toner cartridge 1 may be made in a longitudinal shape. The toner stirring member 6 is lifted up more securely by such a projection 17.

Figure 16A:
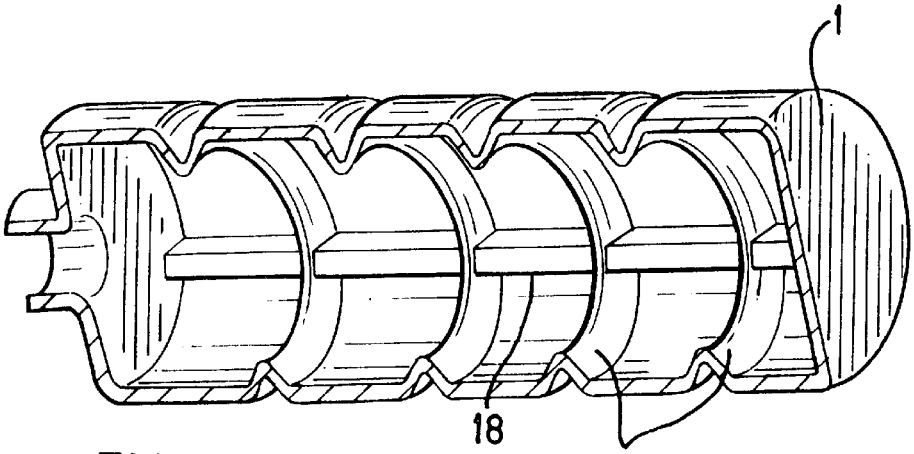
FIG. 16(*a*) is an illustration showing an example of a projection which is provided along a longitudinal direction of the toner cartridge in each space formed by a spiral projection.
Figure 16B:
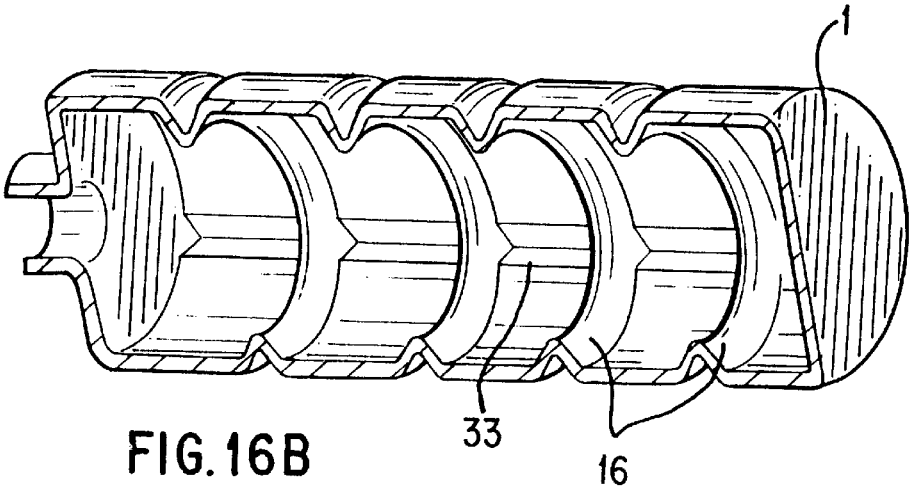

Further, and as shown in FIG. 16(*a*), in addition to providing a spiral projection 16 on the internal surface of the toner cartridge 1, another projection 18 may be provided in a space between the spiral projection 16 extending in the longitudinal direction of the toner cartridge 1. When the toner cartridge 1 rotates, the toner and the toner stirring member 6 are lifted up by the projection 18, and the toner stirring member 6 then falls down, thereby stirring the toner.

As shown in FIG. 16(*b*), the above-mentioned projection 18 may also be replaced by a groove 33 which is deep enough to catch the toner stirring member 6.

Figure 17:
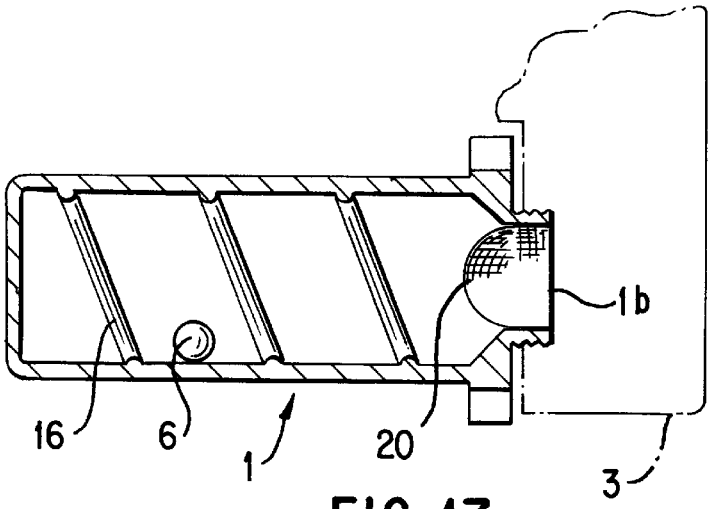
FIG. 17 is an illustration showing an example of another composition of a toner cartridge according to the present invention, which includes a netlike shaped partition member for preventing a toner stirring member from moving out of the toner cartridge.

An example of another composition of the toner cartridge 1 is shown in FIG. 17 in which a spiral-shaped projection 16 is provided on the internal surface of the toner cartridge 1, and the toner in the toner cartridge 1 is moved toward the toner cartridge opening 1*b* along the spiral projection 16 when the toner cartridge 1 rotates. In this embodiment of the present invention, a net-shaped partition member 20 is mounted inside of the opening 1*b*. The toner passes through the net-shaped partition member 20, while the toner stirring member 6 is caught by the net-shaped partition member 20 and is prevented from passing therethrough since an opening of the mesh of the net-shaped partition member 20 is made smaller than a size of the toner stirring member 6. The toner stirring member 6 is thus more securely prevented from moving out of the toner cartridge 1 with this net-shaped partition member 20 than with the aforementioned spiral projection having a discontinuity.

Figure 18A:
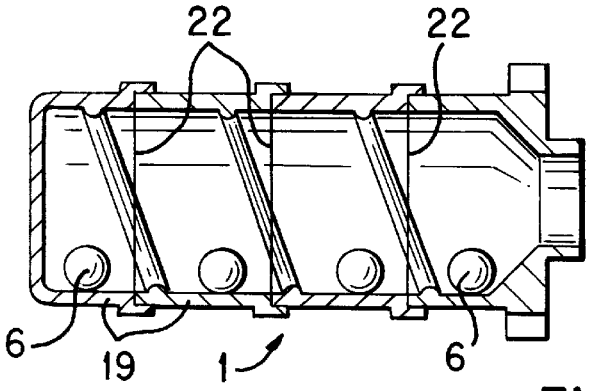
FIG. 18(*a*) and FIG. 18(*b*) are illustrations showing an example of a the toner cartridge whose internal space is divided into a plurality of spaces by net-like shaped partitions.
Figure 18B:
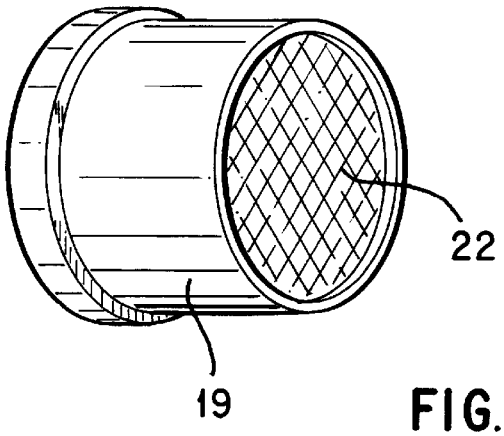

Further, and as shown in FIG. 18(*a*) and FIG. 18(*b*), the toner cartridge 1 may be composed of a plurality of short barrel segments 19 separated by net-shaped partitions 22; FIG. 18(*b*) showing one of the barrel segments 19 with a net-shaped partition 22. Each of the barrel segments 19 includes a net-shaped partition 22 at one end and a toner stirring member 6 is held inside of each barrel segment 19. While toner is moved towards the toner supply unit through the net-shaped partitions 22, the toner stirring members 6 are stopped by the net-shaped partitions 22, and are thus prevented from flowing out towards the toner supply unit.

Figure 19A:
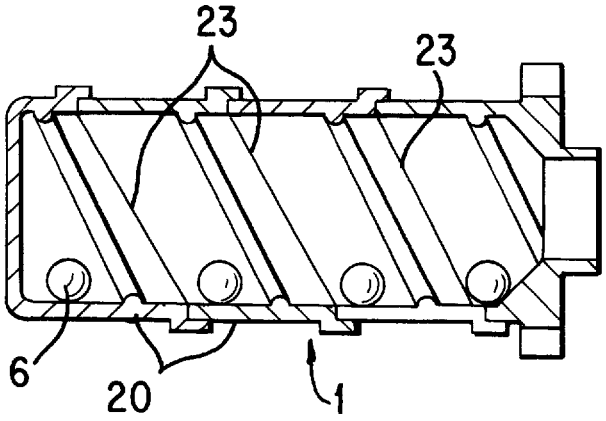
FIG. 19(*a*) and FIG. 19(*b*) are illustrations showing an example of a variation of the toner cartridge shown in FIG. 18.
Figure 19B:
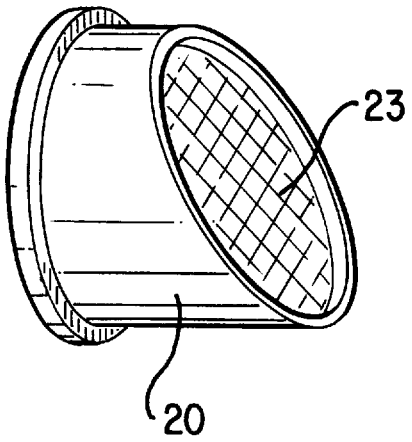

FIGS. 19(*a*) and 19(*b*) illustrate another example of a toner cartridge, which is a variation of the example shown in FIG. 18. In this variation shown in FIGS. 19, a toner cartridge 1 is composed of a plurality of barrel segments 20 as in the embodiment of FIG. 18. However, the barrel segments 20 and a net-shaped partition 23 between each of the barrel segments 20 is placed at an incline with respect to an axis of the toner cartridge 1. The toner stirring members 6 move around inside of each barrel segments 20 more freely because each net-shaped partition 23 is inclined, thus stirring the toner more effectively.

Figure 20A:
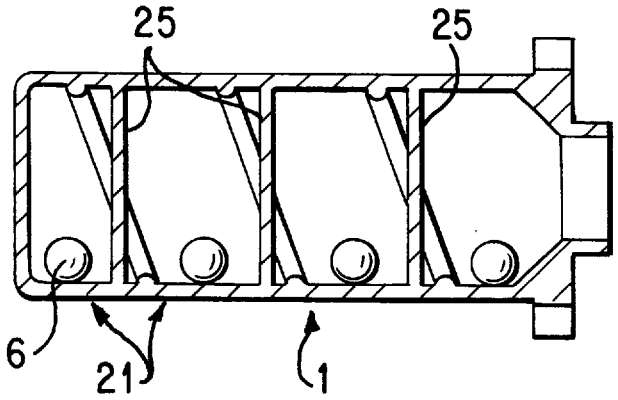
FIG. 20(*a*) is an illustration of a longitudinal sectional view of still another example of a variation of the toner cartridge shown in FIG. 18.
Figure 20B:
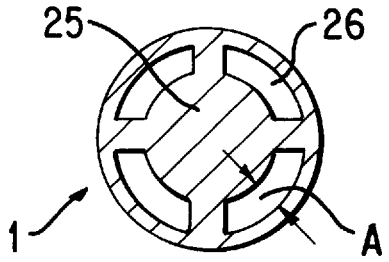
Figure 20C:
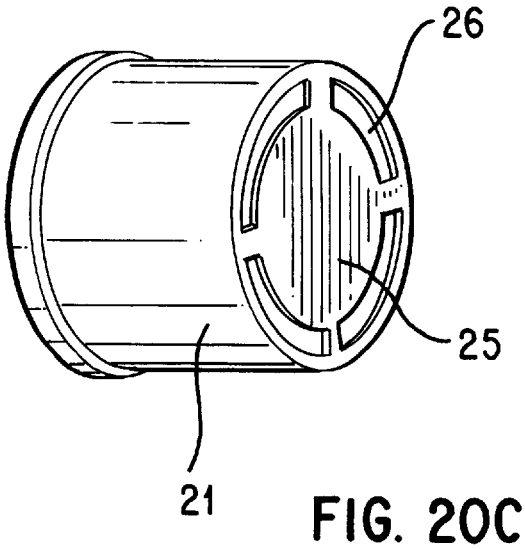

As a further feature of the present invention, as shown in FIG. 20(*a*), a sheet-like partition member 25 is provided in the toner cartridge 1 and has openings 26 for passing the toner therethrough as shown in FIG. 20(*b*). This toner cartridge may also be formed of barrel segments 21, as shown in FIG. 20(*c*). The width A of the openings 26 is smaller than a width of the toner stirring member 6. Therefore, although the toner is moved towards an opening of the toner cartridge 1 through the openings 26, the toner stirring member 6 is prevented from moving out of each barrel segment 21 by the sheet-like partition member 25.

Figure 21:
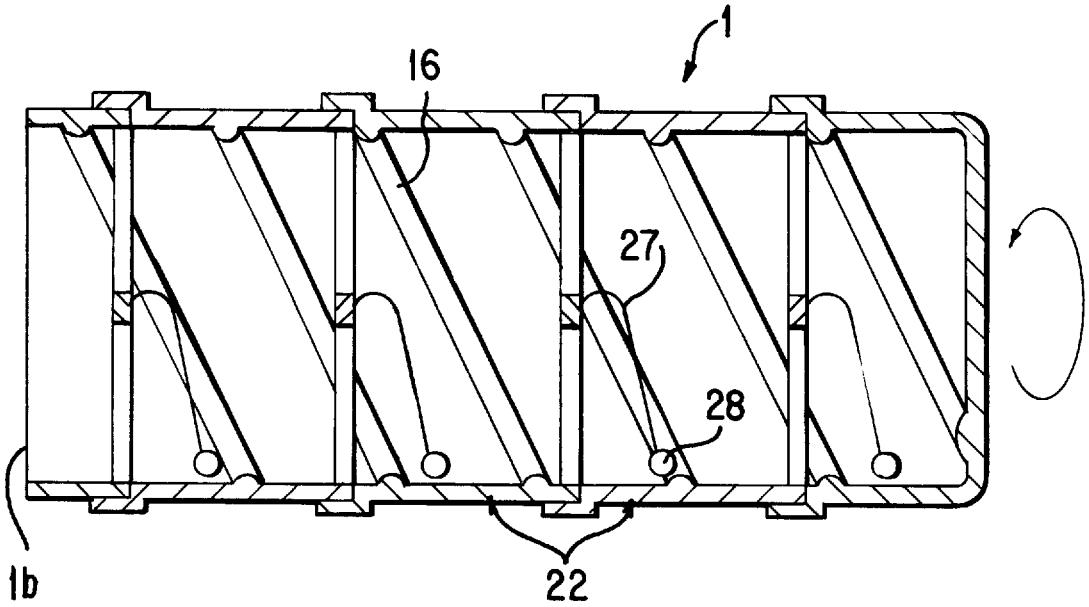
FIG. 21 is a sectional view showing an example of still another composition of a toner cartridge according to the present invention.
Figure 22:
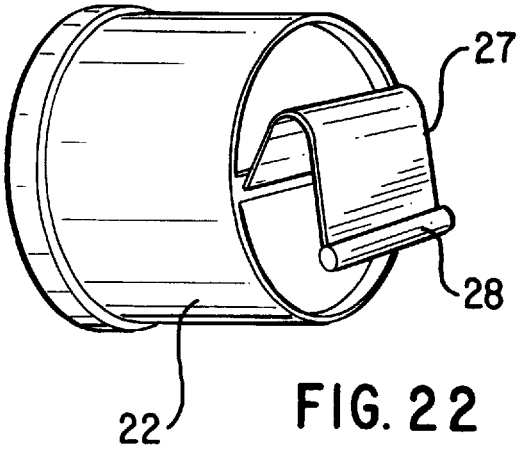
FIG. 22 is a schematic perspective illustration showing a barrel-shaped member which is a component for composing the toner cartridge shown in FIG. 21.

As a further embodiment of the present invention as shown in FIG. 21, a toner stirring member 27 is formed in a thin sheet and is attached to one end surface of each barrel segment which is a component composing the toner supply cartridge 1. These toner stirring members 27 are preferably made of a material whose specific gravity is greater than that of the toner. A weight 28 may be provided at the free end of the toner stirring member 27 to make the toner stirring member 27 heavy. Since the toner stirring member 27 is a thin sheet, the plane part of the sheet pushes apart and stirs the toner. It is preferable that the portion connecting the toner stirring member 27 to the toner cartridge 1 is made easily movable with, for example, a thin sheet as shown in FIG. 22. The connection of the toner stirring member 27 to the toner cartridge 4 may be made via a hinge also.

In a case that a PET resin is used for the toner stirring member 27, the thickness of the toner stirring member 27 is preferably less than 0.5 mm. The weight 28 provided at the tip end of the toner stirring member 27 is indispensable for efficiently stirring the toner when a light material, such as PET, is used for the toner stirring member 27. The toner stirring member 27 moves up and down by its own weight when the toner cartridge 1 rotates, and thereby pushes apart and stirs the toner. The stirred toner gradually moves toward the opening 1*b* of the toner cartridge 1 along the spiral projection 16, and flows out of the toner cartridge 1 and to the toner supply unit 3.

Figure 23:
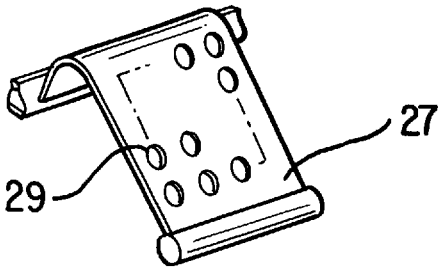
FIG. 23 is a schematic perspective illustration of a toner stirring member which is mounted to the toner cartridge shown in FIG. 21.
Figure 24:
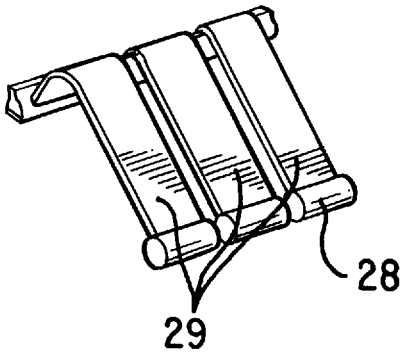
FIG. 24 is a schematic perspective illustration of another toner stirring member which is mounted to the toner cartridge shown in FIG. 21.

As shown in FIG. 23, the thin sheet-like formed toner stirring member 27 may include a plurality of holes 29 which are made through the thin sheet. The toner passes through the holes 29 when the toner stirring member 27 moves, and the toner is stirred efficiently, thereby improving the fluidity of the toner. Even one hole may improve the fluidity of the toner. Further, the toner stirring member 27 may be composed of a plurality of narrow thin sheets 29 as shown as an example in FIG. 24.

In each of the aforementioned embodiments, welding, gluing, an adhesive tape, or the like, may be used for connecting a plurality of the short barrel segments for composing the toner cartridge 1, and the number of the barrel segments to be connected may be adjusted according to a required capacity of each toner cartridge 1.

Figure 25:
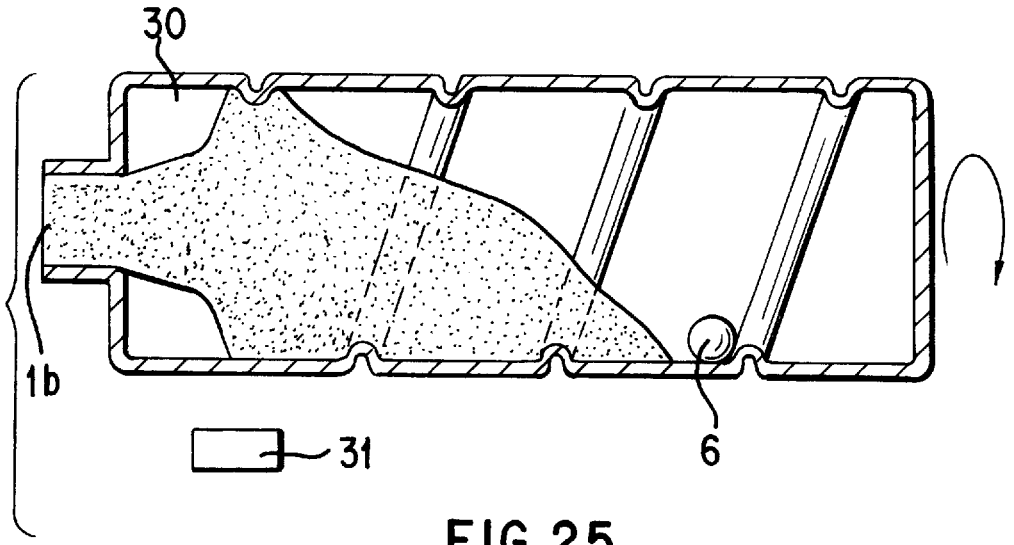
FIG. 25 is a schematic sectional view showing an example of a construction for catching a toner stirring member by a magnet.
Figure 26:
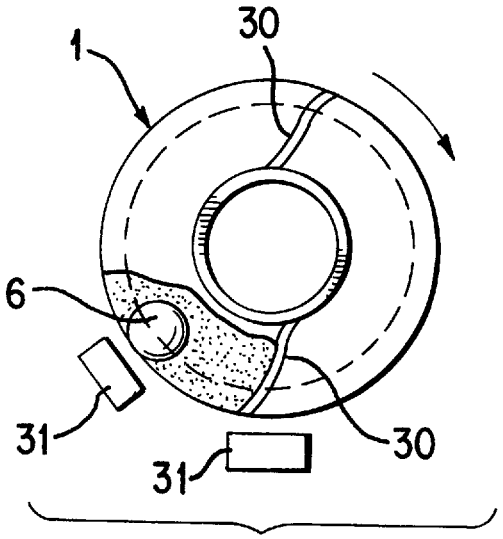
FIG. 26 is a transverse sectional view of the toner cartridge shown in FIG. 25.

Although not shown in each of the drawings which are referred to in the previous embodiments, as foreseeable from a shape of the toner cartridge 1 shown in FIG. 2, a slope 30, see FIG. 25, for guiding the toner toward the opening 1*b* of the toner cartridge 1 is generally provided somewhere short of the opening 1*b* of the toner cartridge 1 so that the toner is discharged from the toner cartridge 1 smoothly. However, such a slope 30 may also help in discharging the toner stirring member 6 from the toner cartridge 1 through the opening 1*b*, in a case that the net-shaped partitions 20, 22, or 23, or the sheet-like partition 25, is not provided. Therefore, for preventing such a discharge of the toner stirring member 6 from the toner cartridge 1, there may be provided near the opening 1*b* of the toner cartridge 1, outside and around the toner cartridge 1, a member 31 for catching a toner stirring member 6, as shown in FIGS. 25 and 26.

If the toner stirring member 6 is made of a magnetizable metal or the like and the member 31 is made of a permanent magnet, the toner stirring member 6 is attracted by the member 31 and is prevented from moving out of the toner cartridge 1 through the opening 1*b*. Generally, the member 31 is placed near the opening 1*b* of the toner cartridge 1 where the toner is gathered. The member 31 is preferably positioned under the toner cartridge 1 or downstream of the rotation of the cartridge as shown in FIG. 26, considering that the specific gravity of the toner stirring member 6 is greater than that of the toner and the direction to which the toner stirring member 6 is carried with the rotation of the toner cartridge 1. Stirring member 6 may also be the permanent member and member 31 may be the magnetizable material.

Obviously, numerous additional modifications and variations of the present invention are possible in light of the above teachings. It is therefore to be understood that within the scope of the appended claims, the present invention may be practiced otherwise than as specifically described herein.

What is claimed as new and desired to be secured by Letters Patent of the United States is:

1. A toner cartridge to be detachably horizontally mounted to a toner-receiving opening of a toner supply unit and rotated for discharging toner, comprising:

a cartridge container for holding toner and having an internal surface;

at least one toner stirring means for scratching off toner from the internal surface of the cartridge container and being mixed in with the held toner in the cartridge container; and a spiral projection formed on the internal surface of the cartridge container, said spiral projection having at least one discontinuity which is larger than the toner stirring member.

2. The toner cartridge according to claim 1, further comprising a projection formed on the internal surface of the cartridge container for catching the toner stirring means.

3. The toner cartridge according to either one of claims 1 or 2, further comprising a member for preventing said toner stirring means from being discharged from the container, said member passing the held toner therethrough.

4. The toner cartridge according to either one of claims 1 or 2, further comprising a partition which divides an internal space of the cartridge container into a plurality of spaces, said partition passing the toner therethrough while preventing said toner stirring means from passing therethrough, and at least one toner stirring means is included in each of said plurality of spaces.

5. The toner cartridge according to either one of claims 1 or 2, wherein said toner stirring means is made of a material whose specific gravity is equal to or greater than a specific gravity of the toner.

6. The toner cartridge according to claim 3, wherein said toner stirring means is made of a material whose specific gravity is equal to or greater than a specific gravity of the toner.

7. The toner cartridge according to claim 4, wherein said toner stirring means is made of a material whose specific gravity is equal to or greater than a specific gravity of the toner.

8. The toner cartridge according to claim 1, further comprising a longitudinal groove formed on the internal surface of the cartridge container for catching the toner stirring means.

9. A toner cartridge to be detachably horizontally mounted to a toner-receiving opening of a toner supply unit and rotated for discharging toner, comprising:

a plurality of cylindrical container segments to be connected to each other to form a cartridge container;

a toner stirring member attached to one end surface of each of the cylindrical container segments.

10. The toner cartridge according to claim 9, wherein said toner stirring member comprises a thin sheet attached to the one end surface of each of the cylindrical container segments and a weight connected to an end of the thin sheet.

11. An image forming apparatus, comprising:

a developing device;

a toner supply unit which supplies toner to the developing device;

a toner cartridge to be detachably horizontally mounted to a toner-receiving opening of the toner supply unit and rotated for discharging toner, said toner cartridge including:

a cartridge container for holding toner and having an internal surface; and at least one toner stirring means for scratching off toner from the internal surface of the cartridge container and being mixed in with the held toner in the cartridge container;

a magnetic member provided around said toner cartridge and one of said toner stirring means or said magnetic member is made of a magnetizable material.

12. The image forming apparatus according to claim 11, wherein said toner cartridge further includes a projection formed on the internal surface of the cartridge container for catching the toner stirring means.

13. The image forming apparatus according to either one of claims 11 or 12, wherein said toner cartridge further includes a member for preventing said toner stirring means from being discharged from the cartridge container, said member passing the held toner therethrough.

14. The image forming apparatus according to claim 13, wherein said toner cartridge includes a spiral projection formed on an internal surface of the toner cartridge.

15. The image forming apparatus according to either one of claims 11 or 12, wherein said toner cartridge further includes a partition which divides an internal space of the cartridge container into a plurality of spaces, said partition passing the toner therethrough while preventing said toner stirring means from passing therethrough, and at least one toner stirring means is included in each of said plurality of spaces.

16. The image forming apparatus according to claim 15, wherein said toner cartridge includes a spiral projection formed on an internal surface of the toner cartridge.

17. The image forming apparatus according to claim 11, wherein said toner stirring means is made of a material whose specific gravity is equal to or greater than a specific gravity of the toner.

18. The image forming apparatus according to claim 17, wherein said toner cartridge includes a spiral projection formed on an internal surface of the toner cartridge.

19. The image forming apparatus according to claim 11, wherein said toner stirring means includes a toner scratch portion for scratching off the toner from the internal surface of the cartridge container.

20. The image forming apparatus according to claim 19, wherein said toner cartridge includes a spiral projection formed on an internal surface of the toner cartridge.

21. The toner cartridge according to claim 11, further comprising a longitudinal groove formed on the internal surface of the cartridge container for catching the toner stirring means.

22. An image forming apparatus, comprising:

a developing device;

a toner supply unit for supplying toner to the developing device; and a toner cartridge to be detachably horizontally mounted to a toner-receiving opening of the toner supply unit and rotated for discharging toner, said toner cartridge being composed of a plurality of cylindrical container segments to be connected to each other, each cylindrical container segment including a respective toner stirring means for scratching off toner from the internal surface of the cartridge container;

wherein said toner stirring member comprises at least one thin sheet connected to an end of each cylindrical container segment and a weight attached to an end of the at least one thin sheet.

23. The image forming apparatus according to claim 22, wherein said toner stirring means comprises at least one thin sheet connected to an end of each cylindrical container segment and a weight attached to an end of the at least one thin sheet.

24. The image forming apparatus according to any one of claims 11, 12, 22 or 23, wherein said toner cartridge includes a spiral projection formed on an internal surface of the toner cartridge.

25. An image forming apparatus comprising:

a developing device;

a toner supply unit for supplying toner to the developing device;

a toner cartridge to be detachably horizontally mounted to a toner-receiving opening of the toner supply unit and rotated for discharging toner, said toner cartridge being composed of a plurality of cylindrical container segments to be connected to each other, each cylindrical container segment including a respective toner stirring means for scratching off toner from the internal surface of the cartridge container; and a magnetic member provided around said toner cartridge, and one of said toner stirring means or said magnetic member is made of a magnetizable material.

26. A toner cartridge to be detachably horizontally mounted to a toner-receiving opening of a toner supply unit and rotated for discharging toner, comprising:

a cartridge container for holding toner and having an internal surface, the cartridge container including an opening at one side end surface with projecting surfaces and at least one shoulder part, wherein the held toner is conveyed from the at least one shoulder part to the projecting surface of the opening to be discharged by rotation of the cartridge container; and at least one toner stirring member mixed in with the held toner in the cartridge container, wherein said toner stirring member includes a toner scratch portion for scratching off the toner from the internal surface of the cartridge container.

27. The toner cartridge according to claim 26, further comprising a projection formed on the internal surface of the cartridge container for catching the toner stirring member.

28. The toner cartridge according to either one of claims 26 or 27, further comprising a member for preventing said toner stirring member from being discharged from the container, said member passing the held toner therethrough.

29. The toner cartridge according to claim 28, wherein said toner stirring member is made of a material whose specific gravity is equal to or greater than a specific gravity of the toner.

30. The toner cartridge according to either one of claims 26 or 27, further comprising a partition which divides an internal space of the cartridge container into a plurality of spaces, said partition passing the toner therethrough while preventing said toner stirring member from passing therethrough, and at least one toner stirring member is included in each of said plurality of spaces.

31. The toner cartridge according to claim 30, wherein said toner stirring member is made of a material whose specific gravity is equal to or greater than a specific gravity of the toner.

32. The toner cartridge according to either one of claims 26 or 27, wherein said toner stirring member is made of a material whose specific gravity is equal to or greater than a specific gravity of the toner.

33. A toner cartridge to be detachably horizontally mounted to a toner-receiving opening of a toner supply unit and rotated for discharging toner, comprising:

a cartridge container for holding toner and having an internal surface;

at least one toner stirring member mixed in with the held toner in the cartridge container; and a spiral projection formed on the internal surface of the cartridge container, said spiral projection having at least one discontinuity which is larger than the toner stirring member.

34. The toner cartridge according to claim 33, further comprising a projection formed on the internal surface of the cartridge container for catching the toner stirring member.

35. The toner cartridge according to either one of claims 33 or 34, further comprising a member for preventing said toner stirring member from being discharged from the container, said member passing the held toner therethrough.

36. The toner cartridge according to claim 35, wherein said toner stirring member is made of a material whose specific gravity is equal to or greater than a specific gravity of the toner.

37. The toner cartridge according to either one of claims 33 or 34, further comprising a partition which divides an internal space of the cartridge container into a plurality of spaces, said partition passing the toner therethrough while preventing said toner stirring member from passing therethrough, and at least one toner stirring member is included in each of said plurality of spaces.

38. The toner cartridge according to claim 37, wherein said toner stirring member is made of a material whose specific gravity is equal to or greater than a specific gravity of the toner.

39. The toner cartridge according to either one of claims 33 or 34, wherein said toner stirring member is made of a material whose specific gravity is equal to or greater than a specific gravity of the toner.

40. The toner cartridge according to either one of claims 33 or 34, wherein said toner stirring member includes a toner scratch portion for scratching off the toner from the internal surface of the cartridge container.

41. An image forming apparatus, comprising:

a developing device;

a toner supply unit which supplies toner to the developing device;

a toner cartridge to be detachably horizontally mounted to a toner-receiving opening of the toner supply unit and rotated for discharging toner, said toner cartridge including:

a cartridge container for holding toner and having an internal surface, the cartridge container including an opening at one side end surface with projecting surfaces and at least one shoulder part, wherein the held toner is conveyed from the at least one shoulder part to the projecting surface of the opening to be discharged by rotation of the cartridge container; and at least one toner stirring member mixed in with the held toner in the cartridge container, and wherein said toner stirring member includes a toner scratch portion for scratching off the toner from the internal surface of the cartridge container.

42. The image forming apparatus according to claim 41, wherein said toner cartridge further includes a projection formed on the internal surface of the cartridge container for catching the toner stirring member.

43. The image forming apparatus according to either one of claims 41 or 42, wherein said toner cartridge further includes a member for preventing said toner stirring member from being discharged from the cartridge container, said member passing the held toner therethrough.

44. The image forming apparatus according to either one of claims 41 or 42, wherein said toner cartridge further includes a partition which divides an internal space of the cartridge container into a plurality of spaces, said partition passing the toner therethrough while preventing said toner stirring member from passing therethrough, and at least one toner stirring-member is included in each of said plurality of spaces.

45. The image forming apparatus according to claim 41, wherein said toner stirring member is made of a material whose specific gravity is equal to or greater than a specific gravity of the toner.

46. The image forming apparatus according to claim 41, wherein said toner cartridge includes a spiral projection formed on an internal surface of the toner cartridge.

47. The image forming apparatus according to claim 41, further comprising a magnetic member provided around said toner cartridge, and one of said toner stirring member or said magnetic member is made of a magnetizable material.

48. An image forming apparatus, comprising:

a developing device;

a toner supply unit for supplying toner to the developing device; and a toner cartridge to be detachably horizontally mounted to a toner-receiving opening of the toner supply unit and rotated for discharging toner, said toner cartridge being composed of a plurality of cylindrical container segments to be connected to each other, each cylindrical container segment including a respective toner stirring member;

wherein said toner stirring member comprises at least one thin sheet connected to an end of each cylindrical container segment and a weight attached to an end of the at least one thin sheet.

49. The image forming apparatus according to claim 48, wherein said toner cartridge includes a spiral projection formed on an internal surface of the toner cartridge.

50. An image forming apparatus, comprising:

a developing device;

a toner supply unit which supplies toner to the developing device;

a toner cartridge to be detachably horizontally mounted to a toner-receiving opening of the toner supply unit and rotated for discharging toner, said toner cartridge including:

a cartridge container for holding toner and having an internal surface, the cartridge container including an opening at one side end surface with projecting surfaces and at least one shoulder part, wherein the held toner is conveyed from the at least one shoulder part to the projecting surface of the opening to be discharged by rotation of the cartridge container;

at least one toner stirring member mixed in with the held toner in the cartridge container; and a spiral projection formed on the internal surface of the cartridge container for catching the toner stirring member.

51. The image forming apparatus according to claim 50, wherein said toner cartridge further includes a member for preventing said toner stirring member from being discharged from the cartridge container, said member passing the held toner therethrough.

52. The image forming apparatus according to claim 50, wherein said toner cartridge further includes a partition which divides an internal space of the cartridge container into a plurality of spaces, said partition passing the toner therethrough while preventing said toner stirring member from passing therethrough, and at least one toner stirring-member is included in each of said plurality of spaces.

53. The image forming apparatus according to claim 50, wherein said toner stirring member is made of a material whose specific gravity is equal to or greater than a specific gravity of the toner.

54. The image forming apparatus according to claim 50, wherein said toner stirring member includes a toner scratch portion for scratching off the toner from the internal surface of the cartridge container.

55. The toner cartridge according to claim 50, further comprising a longitudinal groove formed on the internal surface of the cartridge container for catching the toner stirring member.

56. An image forming apparatus, comprising:

a developing device;

a toner supply unit which supplies toner to the developing device;

a toner cartridge to be detachably horizontally mounted to a toner-receiving opening of the toner supply unit and rotated for discharging toner, said toner cartridge including:

a cartridge container for holding toner and having an internal surface;

at least one toner stirring member mixed in with the held toner in the cartridge container;

a magnetic member provided around said toner cartridge, and one of said toner stirring member or said magnetic member is made of a magnetic material.

57. The image forming apparatus according to claim 56, wherein said toner cartridge further includes a projection formed on the internal surface of the cartridge container for catching the toner stirring member.

58. The image forming apparatus according to claim 56, wherein said toner stirring member is made of a material whose specific gravity is equal to or greater than a specific.

59. The image forming apparatus according to claim 58, wherein said toner cartridge includes a spiral projection formed on an internal surface of the toner cartridge.

60. The image forming apparatus according to claim 56, wherein said toner stirring member includes a toner scratch portion for scratching off the toner from the internal surface of the cartridge container.

61. The image forming apparatus according to claim 60, wherein said toner cartridge includes a spiral projection formed on an internal surface of the toner cartridge.

62. The toner cartridge according to claim 56, further comprising a longitudinal groove formed on the internal surface of the cartridge container for catching the toner stirring member.

63. An image forming apparatus, comprising:

a developing device;

a toner supply unit for supplying toner to the developing device; and a toner cartridge to be detachably horizontally mounted to a toner-receiving opening of the toner supply unit and rotated for discharging toner, said toner cartridge being composed of a plurality of cylindrical container segments to be connected to each other, each cylindrical container segment including a respective toner stirring member; and a magnetic member provided around said toner cartridge, and one of said toner stirring member or said magnetic member is made of a magnetic material.

64. The image forming apparatus according to any one of claims 56, 57 or 63, wherein said toner cartridge includes a spiral projection formed on an internal surface of the toner cartridge.

65. The image forming apparatus according to claim 63, wherein said toner cartridge includes a spiral projection formed on an internal surface of the toner cartridge.

* * * * *

UNITED STATES PATENT AND TRADEMARK OFFICE

CERTIFICATE OF CORRECTION

PATENT NO. : 5,774,772
DATED : June 30, 1998
INVENTOR(S) : Tsukuru KAI, et al.

It is certified that error appears in the above-identified patent and that said Letters Patent is hereby corrected as shown below:

On the title page, Item [30], the Foreign Application Priority Data, is incorrect. It should read:

--Jun.14, 1995 [JP] Japan.....7-147623
Mar. 8, 1996 [JP] Japan.....8-051933--

Signed and Sealed this

Sixteenth Day of March, 1999

*Attest:*

Q. TODD DICKINSON

*Attesting Officer*

*Acting Commissioner of Patents and Trademarks*